US007765764B2

(12) United States Patent
Zambelli et al.

(10) Patent No.: US 7,765,764 B2
(45) Date of Patent: Aug. 3, 2010

(54) DEVICE FOR CONNECTING BEAMS AND PILLARS OR SIMILAR STRUCTURAL ELEMENTS

(76) Inventors: Sergio Zambelli, Via Stezzano, 28, 24050 Zanica (IT); Benito Zambelli, Via Roma, 44, 24050 Zanica (IT)

( * ) Notice: Subject to any disclaimer, the term of this patent is extended or adjusted under 35 U.S.C. 154(b) by 853 days.

(21) Appl. No.: 11/198,237

(22) Filed: Aug. 8, 2005

(65) Prior Publication Data

US 2007/0039279 A1 Feb. 22, 2007

(51) Int. Cl.
*E04B 1/38* (2006.01)

(52) U.S. Cl. ..... 52/702; 52/698; 52/700; 52/252; 52/289; 52/223.13

(58) Field of Classification Search ..... 52/698, 52/649.2, 127, 250, 252, 253, 263, 282.1, 52/283, 289, 702, 251, 223.13, 700
See application file for complete search history.

(56) References Cited

U.S. PATENT DOCUMENTS 3,030,061 A * 4/1962 Jennings ..... 248/354.3
3,817,006 A * 6/1974 Williams ..... 52/127.2
4,048,771 A * 9/1977 Thistlethwaite ..... 52/127.2
4,068,427 A * 1/1978 Camardo ..... 52/127.2
4,083,156 A * 4/1978 Tye ..... 248/354.5
4,304,078 A * 12/1981 Meriwether, Jr. ..... 52/127.2
4,423,977 A * 1/1984 Gilb ..... 403/232.1
4,583,336 A * 4/1986 Shelangoskie et al. ..... 52/250
4,635,413 A * 1/1987 Hansen et al. ..... 52/92.2
4,665,672 A * 5/1987 Commins et al. ..... 52/295
4,872,634 A * 10/1989 Gillaspy et al. ..... 248/354.3
4,951,438 A * 8/1990 Thoresen ..... 52/252
5,386,675 A * 2/1995 Baur et al. ..... 52/250
5,653,078 A * 8/1997 Kies et al. ..... 52/698
5,669,189 A 9/1997 Logiadis et al.
5,956,906 A * 9/1999 Berich et al. ..... 52/149
6,073,405 A * 6/2000 Kasai et al. ..... 52/283
6,112,475 A * 9/2000 Truitt ..... 52/127.2
6,173,809 B1 * 1/2001 Cole et al. ..... 182/3
6,243,996 B1 * 6/2001 Oliver et al. ..... 52/126.1
6,336,892 B1 * 1/2002 Squibb ..... 482/23
6,339,903 B1 * 1/2002 Zambelli et al. ..... 52/167.1

(Continued)

FOREIGN PATENT DOCUMENTS

EP 1 092 814 A 4/2001

(Continued)

*Primary Examiner*—Richard E Chilcot, Jr.
*Assistant Examiner*—Alp Akbasli
(74) *Attorney, Agent, or Firm*—Modiano & Associati; Albert Josif; Daniel J. O'Byrne

(57) ABSTRACT

A device for connecting beams and pillars or similar structural elements, particularly for prefabricated concrete structural elements, comprising a bracket, which forms, when installed, by means of its upper face, a support for the beam, and a first connection for connecting to the pillar the end of the bracket that is designed to be directed toward the pillar, the device further comprising a second connection for connecting a region of the bracket, spaced from the end directed toward the pillar, to a region of the pillar located above the bracket and arranged on the side of the pillar that lies opposite with respect to the side that bears the bracket.

20 Claims, 4 Drawing Sheets

U.S. PATENT DOCUMENTS 6,345,473 B1 * 2/2002 Fink et al. ..... 52/167.1
6,397,535 B1 * 6/2002 Kim et al. ..... 52/250
6,584,741 B1 * 7/2003 Hatzinikolas ..... 52/289
6,647,678 B1 * 11/2003 Zambelli et al. ..... 52/252
7,010,891 B1 * 3/2006 Clark et al. ..... 52/283
7,140,155 B1 * 11/2006 Nasimov ..... 52/236.8
7,287,358 B2 * 10/2007 Zambelli et al. ..... 52/649.2
7,380,372 B2 * 6/2008 Resch et al. ..... 52/127.2
7,520,101 B2 * 4/2009 Berg et al. ..... 52/706
2001/0032434 A1 * 10/2001 Hoffmann et al. ..... 52/702
2002/0184836 A1 * 12/2002 Takeuchi et al. ..... 52/167.1
2003/0084629 A1 * 5/2003 Strickland et al. ..... 52/289
2004/0244330 A1 * 12/2004 Takeuchi et al. ..... 52/729.1
2005/0144890 A1 * 7/2005 Kim et al. ..... 52/720.1
2009/0165408 A1 * 7/2009 Pask ..... 52/236.3

FOREIGN PATENT DOCUMENTS

GB 2 179 115 A 2/1987

* cited by examiner 1
3
9b
14b
2
7b
27
24
15b
6
17b
18
16b
19
16a
17a
19
4
14a
9a
10
7a
15a
8
5

3
29
2
27
12
28
10
8
12
7a
25b
26a
25a
23
24
22
21
26b
5

DEVICE FOR CONNECTING BEAMS AND PILLARS OR SIMILAR STRUCTURAL ELEMENTS

The present invention relates to a device for connecting beams and pillars or similar structural elements, particularly for prefabricated concrete structural elements.

BACKGROUND OF THE INVENTION

As is known, the connection between a beam and a pillar, in buildings erected with prefabricated concrete components, is achieved by means of brackets which are formed monolithically with the pillar or are applied, for example by means of bolts, to the body of the pillar. These brackets can be made of reinforced concrete or steel and can be external to the dimensions of the beam or, as in the case of the so-called Gerber cantilever, can be accommodated in an appropriately provided seat formed on the lower side of the beam at the end of such beam that is designed to face the pillar.

In the first case, problems can arise as a consequence of the space occupation entailed by the body of the bracket below the beam.

In the second case, the seat formed in the body of the beam reduces the resisting cross-section of the beam at the seat, very often forcing an oversizing of the entire beam in order to achieve the required strength.

Moreover, if the bracket is formed monolithically with the pillar or is preassembled to the body of the pillar, storage and transport problems occur as a consequence of the additional space occupation of the bracket laterally with respect to the pillar.

SUMMARY OF THE INVENTION

The aim of the present invention is to solve the problems described above by providing a device for connecting beams and pillars or similar structural elements, particularly for prefabricated concrete structural elements, which allows to provide a bracket which, for an equal resistance to loads, can have a considerably reduced height with respect to conventional types of brackets.

Within this aim, an object of the invention is to provide a device that allows to reduce the vertical dimensions of the seat of the beam optionally designed to accommodate the bracket and accordingly limit the vertical oversizing of the beam.

Another object of the invention is to provide a device that does not require preassembly of the bracket to the pillar, thus simplifying pillar transport operations.

Another object of the invention is to provide a device that allows to recover any errors in the coupling between the beam and the pillar.

Another object of the invention is to provide a device that is simple and quick to install.

This aim and these and other objects which will become better apparent hereinafter are achieved by a device for connecting beams and pillars or similar structural elements, particularly for prefabricated concrete structural elements characterized in that it comprises:

- a bracket, which forms, when installed, by means of its upper face, a support for the beam;
- first means for connecting to the pillar the end of said bracket that is designed to be directed toward the pillar;
- second means for connecting a region of said bracket, which is spaced from said end, to a region of the pillar which is located above said bracket and is arranged on the side of said pillar that lies opposite with respect to the side that bears said bracket.

BRIEF DESCRIPTION OF THE DRAWINGS

Further characteristics and advantages of the invention will become better apparent from the description of a preferred but not exclusive embodiment of the device according to the invention, illustrated by way of non-limiting example in the accompanying drawings, wherein.

DESCRIPTION OF THE PREFERRED EMBODIMENTS

Figure 1:
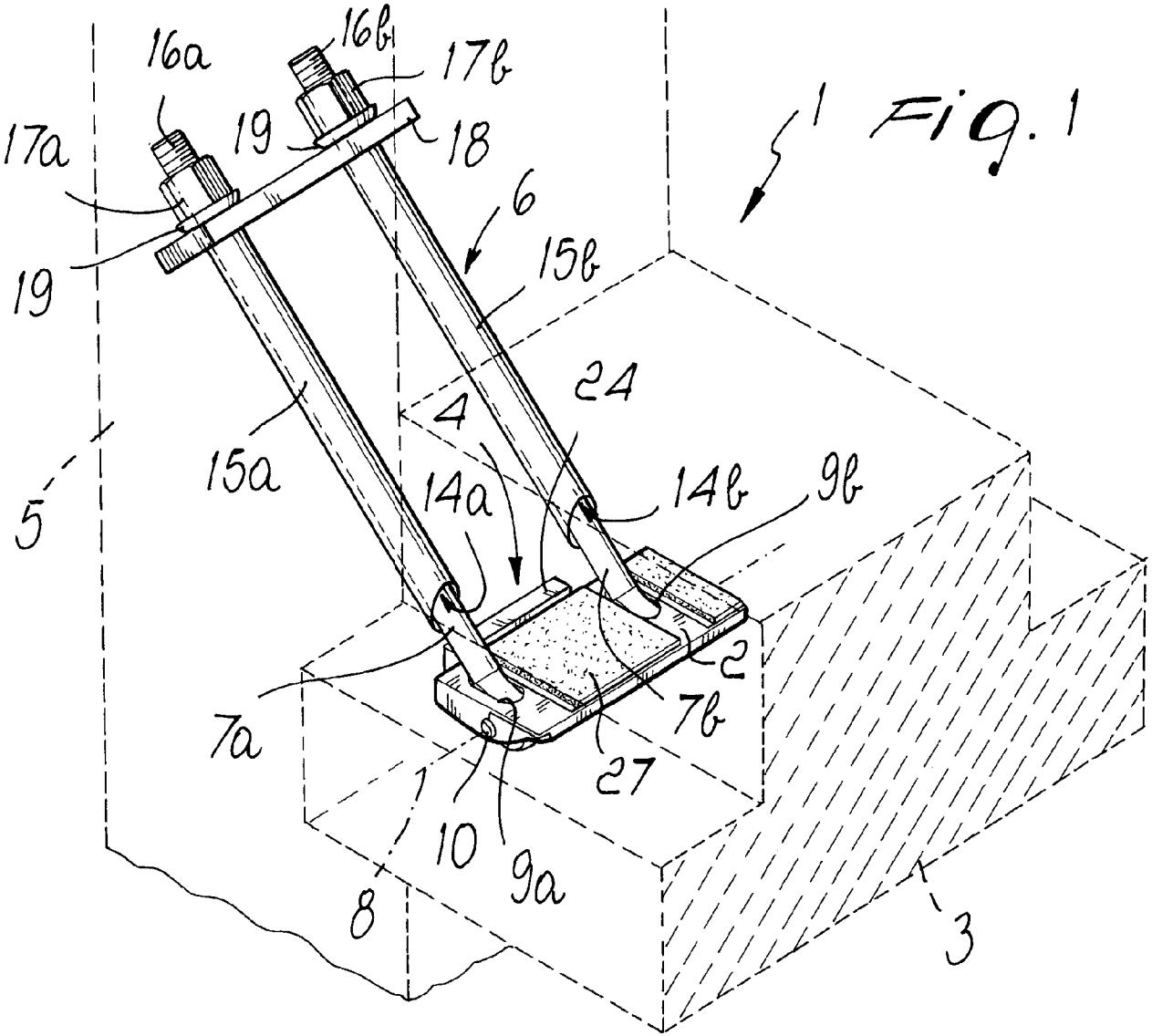
FIG. 1 is a perspective view of the device according to the invention after installation, with the pillar and the beam shown in phantom lines.
Figure 2:
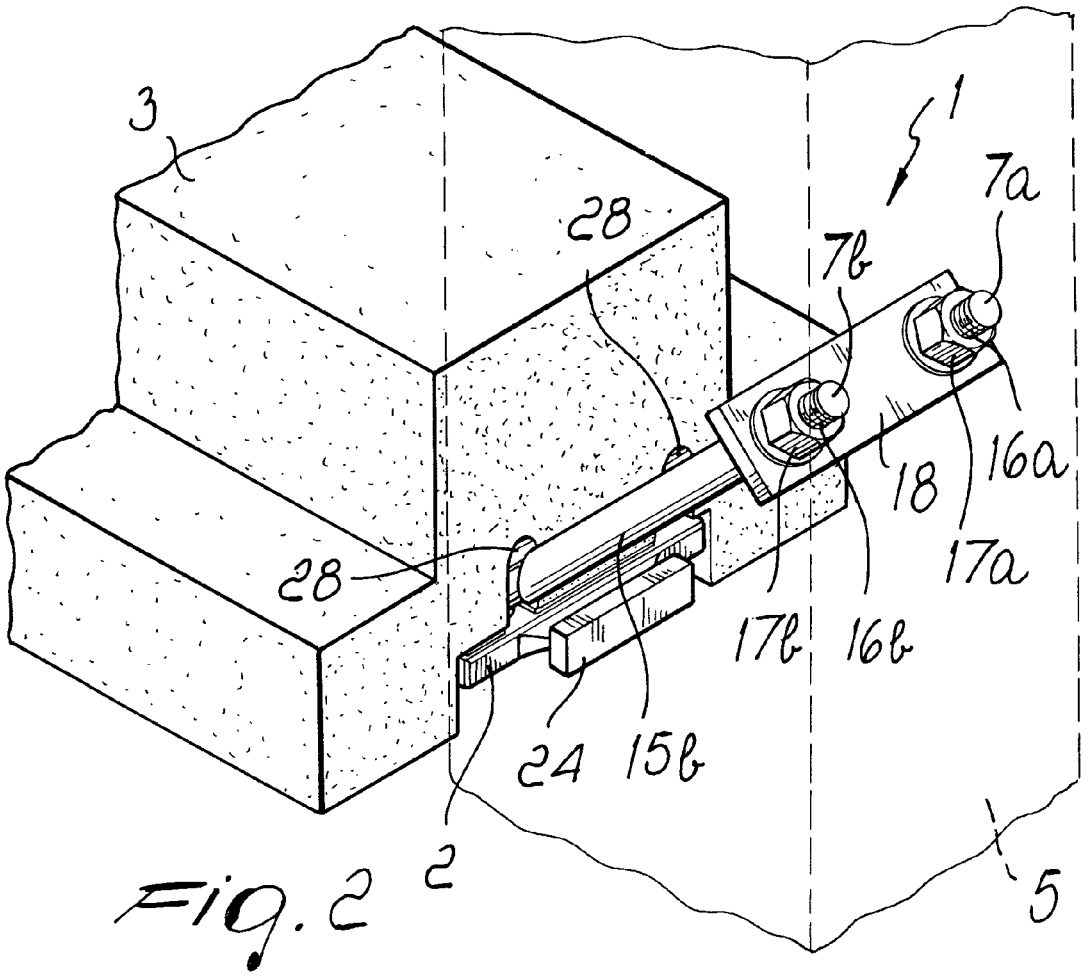
FIG. 2 is a perspective view of the device according to the invention after installation, taken from a different angle with respect to FIG. 1, with the pillar shown in phantom lines.
Figure 5:
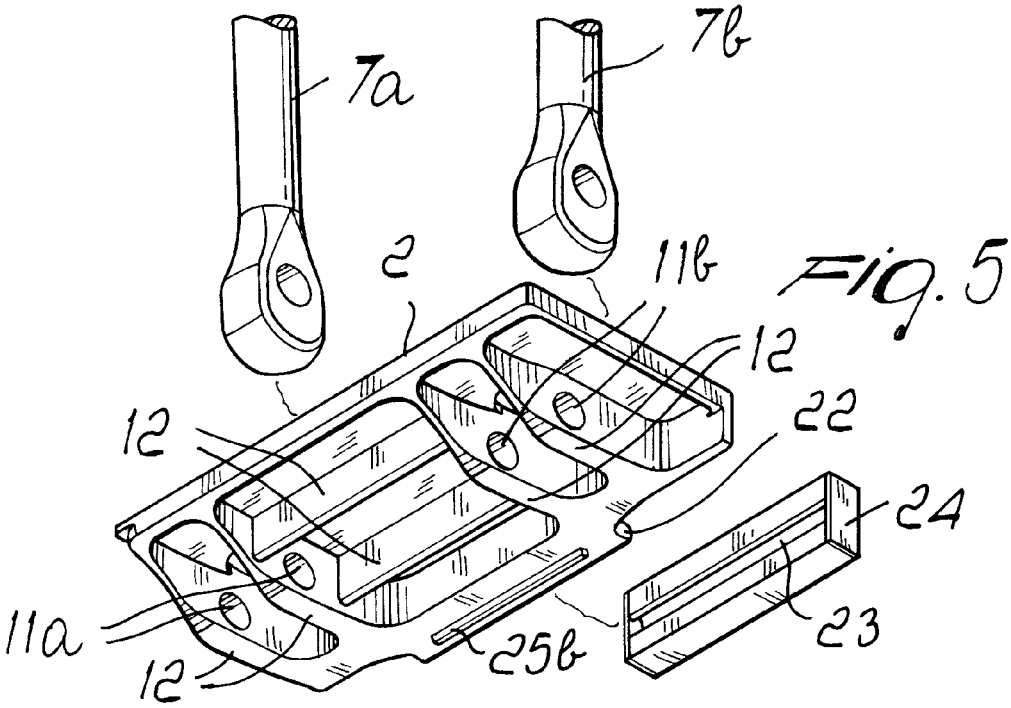
FIG. 5 is an exploded perspective view of components of the device according to the invention.

With reference to the figures, the device according to the invention, generally designated by the reference numeral 1, comprises a bracket 2, which forms by means of its upper face, once installed, a support for a beam 3. The device further comprises first connection means 4 for connecting to a pillar 5 the end of the bracket 2 that is designed to be directed toward the pillar 5 and second connection means 6 for connecting a region of the bracket 2 which is spaced from said end to a region of the pillar 5 which is arranged above the bracket 2 and on the side of the pillar 5 that lies opposite with respect to the side that bears the bracket 2.

The second connection means 6 comprise at least one tension member 7*a*, 7*b*, which is connected, by means of its lower end, to the bracket 2 and, by means of its upper end, to a region of the pillar 5 that is arranged above the bracket 2. The tension member 7*a*, 7*b* is preferably a tension member of the rigid type, constituted for example by a steel bar.

The lower end of the tension member 7*a*, 7*b* is pivoted to the bracket 2 about a substantially horizontal first pivoting axis 8, which, once the bracket is installed, is parallel to the face of the pillar 5 that is directed toward the bracket 2.

The lower end of the tension member 7*a*, 7*b* can have conveniently a teardrop shape, and pivoting to the bracket 2 is preferably performed below the supporting surface for the beam 3 and below the upper face of the bracket 2 by providing in said bracket appropriate passages 9*a*, 9*b* for the tension member 7*a*, 7*b*. Pivoting between the tension member 7*a*, 7*b* and the bracket 2 is provided by means of a first connection with a pivot 10, the axis whereof determines the pivoting axis 8, which passes through the end of the tension member 7*a*, 7*b* and mates in seats 11*a*, 11*b* provided appropriately in the body of the bracket 2.

The bracket 2 has stiffening ribs 12, preferably on its lower face, and the seats 11*a*, 11*b* can be formed in said stiffening ribs 12.

The second connection of the upper end of the tension member 7*a*, 7*b* to the pillar 5 also is preferably constituted by a connection of the type provided with a hinge in which the second pivoting axis 13 is substantially horizontal, when the bracket 2 is installed, and parallel to the face of the pillar 5 that is directed toward the bracket 2.

More particularly, the tension member 7*a*, 7*b* passes through a through passage 14*a*, 14*b*, which is formed in the pillar 5 and is connected to the side of the pillar 5 that lies opposite with respect to the side provided with the bracket 2.

The passage 14*a*, 14*b* is formed by a tubular body 15*a*, 15*b*, which is incorporated beforehand in the body of the pillar 5 during its manufacture.

Advantageously, tension means for tensioning the tension member 7*a*, 7*b* are provided. The tension member 7*a*, 7*b* in fact has at least one portion thereof 16*a*, 16*b*, starting from its end that lies opposite with respect to the bracket 2, which is threaded and mates with a nut 17*a*, 17*b*, that form the tension means which once installed rests against a plate 18, which in turn rests against the side of the pillar 5 that lies opposite the side provided with the bracket 2.

The threading of the tension members 7*a*, 7*b* can be performed by chip-forming machining or by rolling or can be constituted by helical ribs that are already present on the lateral surface of the tension members, for example by using as tension members reinforcement bars which already have helical ribs for increasing grip on the concrete, which can be used as threads.

Preferably, the plate 18 is accommodated in a recess 30 which is provided for this purpose in the body of the pillar 5.

The nut 17*a*, 17*b*, in addition to the portion that is directed away from the plate 18 and is contoured so as to be handled with conventional fastening tools, for example of the hexagonal prism-like type, is provided with a portion 19 shaped like a spherical dome, which mates with a corresponding spherical dome-shaped seat 20 formed within the plate 18. The mating between the nut 17*a*, 17*b* and said spherical dome-shaped seat 20 allows the tension member 7*a*, 7*b* to perform small rotations and provides said hinged connection between the upper end of the tension member 7*a*, 7*b* and the plate 18 or pillar 5.

Conveniently, the second connection means comprise two tension members 7*a*, 7*b*, which are arranged side by side and parallel to each other and are pivoted by means of their lower end to the bracket 2, preferably about a same pivoting axis 8, and, by means of their upper end, to the pillar 5, preferably about a same pivoting axis 13, which is formed by the coupling between the spherical dome-shaped portions 19 of the nuts 17*a*, 17*b* and the spherical dome-shaped seats 20.

The first connecting means can provide a connection of the interlocking type, for example by bolting the bracket 2 to the pillar 5.

Preferably, the first connection means 4 also provide an additional connection between the bracket 2 and the pillar 5 with an additional pivoting axis 21 which is substantially horizontal and likewise parallel to the face of the pillar 5 that is directed toward the bracket 2.

Said first connection means 4 preferably comprise a protrusion 22 of the bracket 2, which protrudes toward the pillar 5 and engages a seat 23 formed in an insert 24, which is preferably incorporated in the body of the pillar 5. The protrusion 22 and the seat 23 are contoured so as to provide a hinge-like connection, i.e., so that the protrusion 22 and therefore the bracket 2 can rotate with respect to the insert 24, i.e., with respect to the pillar 5, about the pivoting axis 21.

Conveniently, the protrusion 22 has retention teeth 25*a*, 25*b*, which can engage in abutments 26*a*, 26*b* provided on the insert 24 in order to limit the rotation, during installation, of the bracket 2 with respect to the pillar 5 about the pivoting axis 21.

Preferably, on the upper face of the bracket 2 there is a layer 27 made of elastically deformable material, for example neoprene, rubber or similar material, so as to achieve a uniform and coplanar distribution of the forces exchanged between the beam 3 and the bracket 2.

The end region of the beam 3 that rests against the bracket 2 can be recessed so as to eliminate the space occupation of the bracket 2 below the beam 3. Moreover, the beam 3 has hollows 28 for the passage of the tension members 7*a*, 7*b*.

Figure 3:
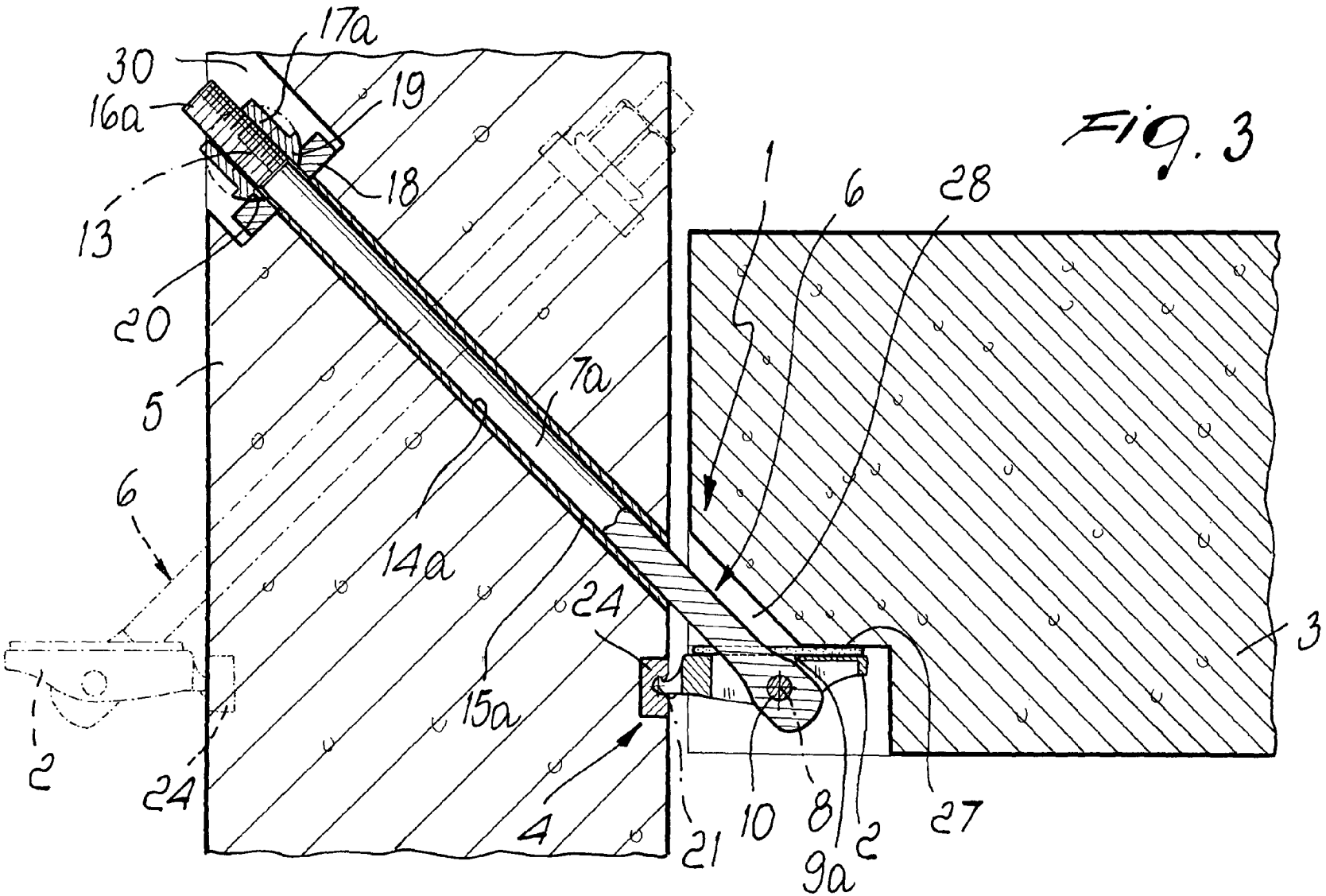
FIG. 3 is a partially sectional view of the device according to the invention, taken along a vertical plane.
Figure 4:
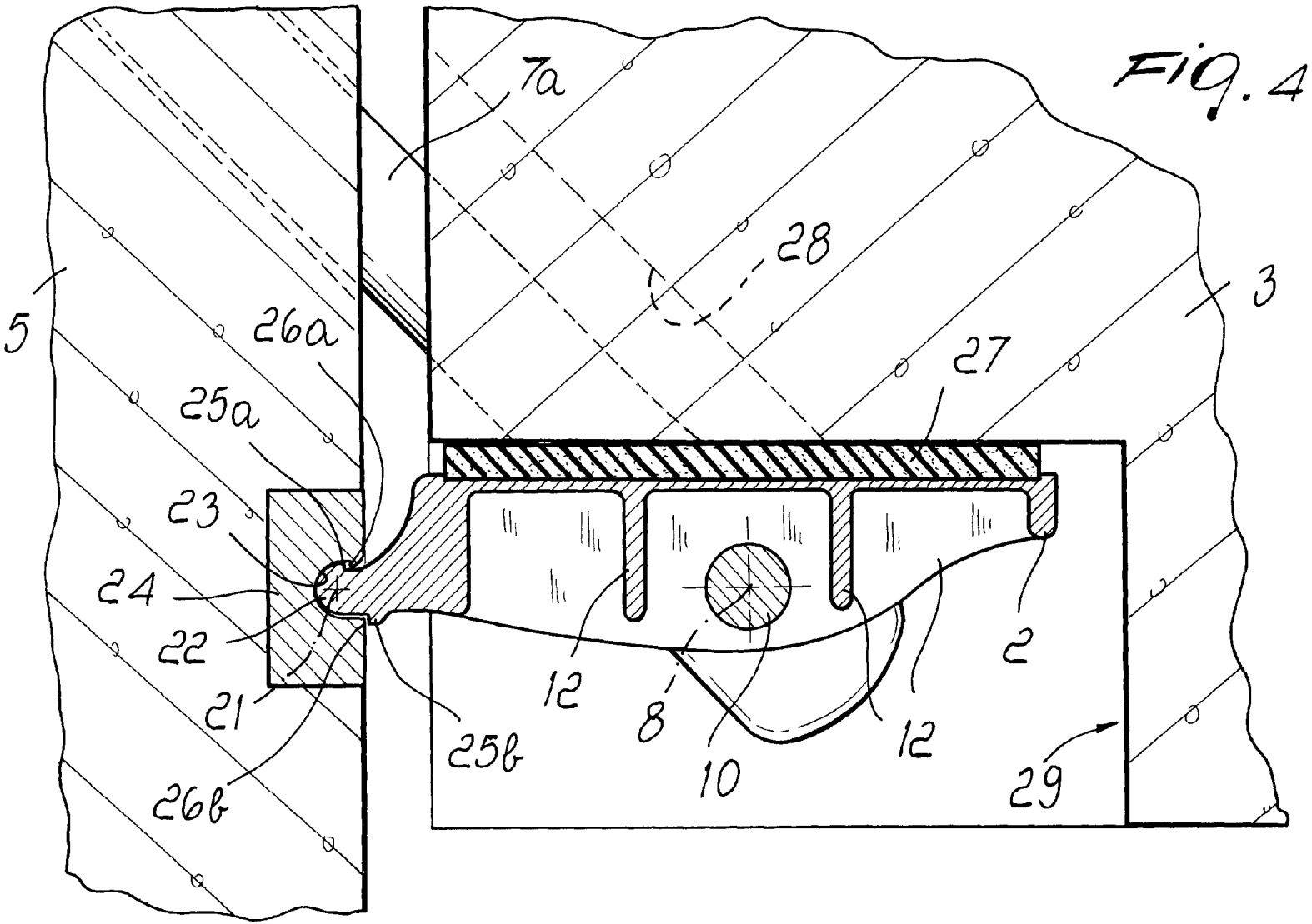
FIG. 4 is an enlarged-scale sectional view, taken along a vertical plane, of a portion of the device according to the invention.

It should be noted that the pillar 5 can bear brackets 2 on two opposite sides thereof. In this case, the tension members 7*a*, 7*b* that support the two brackets 2 are conveniently offset and crossed within the pillar 5, as shown in FIG. 3.

In practice, the device according to the invention, thanks to the fact that the bracket 2 is supported in an intermediate region by at least one tension member which connects it to a region of the pillar 5 that lies above said bracket 2, is capable of withstanding intense loads despite a height of the bracket 2 that is considerably reduced with respect to the height of brackets used in traditional types of pillar-beam connections. This fact allows to minimize the space occupation of the bracket 2 below the beam 3. Moreover, if the bracket 2, as in the illustrated embodiment, is accommodated in a recess 29 provided in the lower face of the beam 3, thanks to the reduced height of the bracket 2 the oversizing of the beam can be reduced or may even be unnecessary.

Moreover, it should be noted that the device according to the invention allows to have no lateral protrusions on the pillar before its installation, thereby facilitating its transport.

Another advantage of the device according to the invention is that it allows, by tightening the nuts 17*a*, 17*b*, to adjust the position of the bracket 2 with respect to the pillar 5, allowing to correct any positioning errors between the beam 3 and the pillar 5.

In practice it has been found that the device according to the invention fully achieves the intended aim, since for an equal resistance to loads it allows to reduce considerably the height of the bracket with respect to the height required for brackets in known types of beam-pillar connections.

The device thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

What is claimed is:

1. A device for connecting structural elements of the type of beams and pillars, comprising:

a bracket, that has an upper face that forms a support for a beam at installation;

first connection means to connect an end of said bracket to a second side of a pillar at installation;

second connection means to connect a region of said bracket remote from said end of said bracket, to a region of the pillar at a first side opposite the second side and located above said bracket at installation, wherein said second connection means comprises at least one tension member, which is connected, by way of a lower end thereof, to said bracket and, by way of an upper end thereof, to said region of the pillar that lies above said bracket and is arranged on the first side of said pillar that lies opposite with respect to the second side that bears said bracket, and wherein a through passage formed in said pillar is provided for passage of said tension member that is connected to the first side of said pillar that lies opposite the second side that bears said bracket.

2. The device of claim 1, wherein said tension member is substantially rigid.

3. The device according of claim 1, comprising a first connection between said lower end of said tension member and said bracket that is of the hinged type and has a first pivoting axis which lies, at installation of the bracket, substantially horizontal and parallel to a face of the pillar that is directed toward the bracket.

4. The device of claim 3, further comprising a second connection between said upper end of the tension member and the pillar that is of the hinged type, with a second pivoting axis which, at installation of the bracket, is substantially horizontal and parallel to the face of the pillar that is directed toward the bracket.

5. The device of claim 4, wherein said first connection is located below said upper face of the bracket, a passage for said tension member being provided within said bracket.

6. The device of claim 1, wherein said through passage in said pillar for said tension member comprises a tubular body which is embedded in said pillar.

7. The device of claim 1, further comprising tension means for tensioning said tension member.

8. The device of claim 7, wherein said tension means comprise at least one portion of said tension member, starting from the upper end thereof, which is threaded and a nut which abuts against said pillar and is tightenable in order to tension said tension member.

9. The device of claim 8, comprising an abutment plate which rests against said pillar and is crossed by said tension member, said nut having a side thereof directed toward the pillar which is shaped as a spherical dome that mates with a complementarily shaped seat, which is formed in said abutment plates.

10. The device of claim 9, comprising a pair of tension members.

11. The device of claim 10, wherein said tension members are substantially parallel.

12. The device of claim 11, wherein said tension members have first pivoting axes for pivoting to said bracket that coincide.

13. The device of claim 12, wherein said tension members have second pivoting axes for pivoting to said pillar that coincide.

14. The device of claim 4, wherein said first connection means provide an additional connection of the hinged type between said bracket and the pillar with an additional pivoting axis which, when the bracket is installed, is substantially horizontal and parallel to the face of the pillar that is directed toward the bracket.

15. The device of claim 14, wherein said first connection means comprise a protrusion of said bracket which protrudes, upon installation, toward the pillar and is engageable with a seat formed by an insert which is embedded in said pillar.

16. The device of claim 15, wherein said protrusion has at least one retention tooth, which is engageable with an abutment provided on said insert in order to limit rotation of said bracket with respect to said pillar about said corresponding additional pivoting axis.

17. The device of claim 1, comprising a layer of elastically flexible material that is arranged on the upper face of said bracket.

18. The device of claim 17, wherein said bracket has stiffening ribs on a lower face thereof.

19. The device of claim 10, wherein a recess is provided in the beam for support thereof on said bracket.

20. The device of claim 19, wherein hollows are provided in the beam for passage of said at least one tension member.

* * * * *